United States Patent [19]

Stol

[11] 4,429,652

[45] Feb. 7, 1984

[54] ULTRASONIC EXCITATION OF UNDERWATER TORPEDOES FOR ENHANCING MANEUVERABILITY, SPEED AND TARGETING ACCURACY

[75] Inventor: Israel Stol, Monroeville, Pa.

[73] Assignee: Invocas, Inc., Columbus, Ohio

[21] Appl. No.: 324,010

[22] Filed: Nov. 23, 1981

[51] Int. Cl.[3] ..... F42B 19/01

[52] U.S. Cl. ..... 114/20 R; 114/21 A; 114/23; 114/67 A

[58] Field of Search ..... 114/20 R, 23, 67 R, 114/67 A, 21 A; 244/130

[56] References Cited

U.S. PATENT DOCUMENTS

| | | | |
|---|---|---|---|
| 2,366,162 | 1/1945 | Vang | 114/67 R |
| 2,409,632 | 10/1946 | King | 114/21 A |
| 2,585,676 | 2/1952 | Poisson-Quinton | 244/208 |
| 2,783,008 | 2/1957 | Bodine, Jr. | 239/481 |
| 2,853,852 | 9/1958 | Bodine, Jr. | 244/130 X |
| 2,874,922 | 2/1959 | Whitcomb | 244/130 |
| 2,899,150 | 8/1959 | Ellis, Jr. | 244/130 X |
| 3,008,673 | 11/1961 | Caddell | 114/280 X |
| 3,041,992 | 7/1962 | Lee | 114/312 |
| 3,082,401 | 3/1963 | Bland et al. | 114/20 R X |
| 3,099,993 | 8/1963 | Smith | 137/13 |
| 3,138,129 | 6/1964 | Bankston et al. | 114/20 R |
| 3,145,679 | 8/1964 | Brooks | 114/23 |
| 3,224,375 | 12/1965 | Hoff | 244/130 X |
| 3,774,867 | 11/1973 | Quinn | 244/130 X |
| 3,934,846 | 1/1976 | Maurer | 244/130 |
| 3,971,084 | 7/1976 | Spier | 114/67 R X |

*Primary Examiner*—David H. Brown

*Attorney, Agent, or Firm*—Cushman, Darby & Cushman

[57] ABSTRACT

For enhancing the maneuverability, speed, survivalbility, and targeting accuracy of a torpedo moving below the surface of a body of water, ultrasonic vibrations are set-up at the exterior of the torpedo hull, using controlled piezoelectric crystals to generate the vibrations in the 5-50 KHZ and 5-30 KW frequency and power ranges. Ways are disclosed for operating the piezoelectric crystals to steer the hull without need for mechanically moving parts such as flaps or fins.

13 Claims, 6 Drawing Figures

ULTRASONIC EXCITATION OF UNDERWATER TORPEDOES FOR ENHANCING MANEUVERABILITY, SPEED AND TARGETING ACCURACY

BACKGROUND OF THE INVENTION

Friction is the major factor that resists motion of objects in fluids of any type. About any object that moves in water, there is a motionless layer of water, called "boundary-layer". The water in this layer is motionless because of the extremely high shear forces experienced by it. For a given fluid viscosity, (which is a function of temperature), the faster the object moves in it, the thinner the boundary-layer becomes. The change is accompanied by intensification of the shear forces within the layer. Because these forces interact with the water flowing relative to the moving object, the overall resistance of the water to the object's advancement increases.

Objects designed for high advancement rates in water, (e.g. torpedoes) are configured to form about them laminar water flow patterns. These patterns are conducive to easier advancement. Objects with shapes and/or surfaces which create turbulent water flow patterns about themselves encounter more severe water resistance. The effects of torpedoes' shapes and surfaces on water resistance to their advancement rate is mentioned in here for background information only. Substantial work was and is conducted in the area of torpedoes' optimized configurations. This invention does not deal with the subject.

The present invention deals only with reduction of resistance of water to motion of torpedoes through alteration of the motionless "boundary-layer" and its close vicinity.

Attempts have been made in the prior art to disturb the boundary layer through controlled discharges of water jets, air bubbles, or oil. These attempts have met with differing but unpublished degrees of success.

In the U.S. patent of Lee, U.S. Pat. No. 3,041,992, issued July 3, 1962, a cone is projected in advance of the nose of a torpedo for the purpose of creating a cavitation bubble in which the torpedo may more effortlessly travel. At column 2, lines 24–31 modulation of the spatial orientation of the cavitation bubble is described as a means for steering the torpedo.

There exist recognitions in the prior art that vibrations induced at or near the surface of a body that is travelling through a fluid medium can be used to break up the boundary layer, aid in shedding vortices, and to cancel-out unwanted vibrations.

Caddell, U.S. Pat. No. 3,008,673, issued Nov. 14, 1961 provides a bridge between the problem of moving an airfoil through the air and moving a hydrofoil through a liquid medium such as water.

Some of the prior art relates to the problem of easing the flow of a fluid through a tubular structure. Bodine, Jr., U.S. Pat. No. 2,853,852, issued Sep. 30, 1958 provides an example, as does Smith, U.S. Pat. No. 3,099,993, issued Aug. 6, 1963.

Bodine, Jr., also has an earlier U.S. Pat. No. 3,783,008, which relates to easing the passage of a wing through the air. Thus, there is some appreciated analogy in the prior art between slipping fluid through a tube and slipping an object through a fluid.

Ellis, Jr., U.S. Pat. No. 2,899,150, issued Aug. 11, 1959, Quinn, U.S. Pat. No. 3,774,867, issued Nov. 27, 1973 and Poisson-Quinton, U.S. Pat. No. 2,585,676, issued Feb. 12, 1952, are further examples of a wing drag reduction by boundary air layer disturbance. A related problem is treated in Maurer, U.S. Pat. No. 3,934,846, issued Jan. 27, 1976: how to reduce drag and vibration caused to an aircraft, e.g. a bomber, when a cavity, such as a bomb bay is opened.

The use of controlled electromagnetic radiation at the nose cone of a re-entering space vehicle to cause a shedding of a plasma layer, as is described in Hoff, U.S. Pat. No. 3,224,375.

SUMMARY OF THE INVENTION

For enhancing the maneuverability, speed, survivability, and targeting accuracy of a torpedo moving below the surface of a body of water, ultrasonic vibrations are set up at the exterior of the torpedo hull, using controlled piezoelectric crystals to generate the vibrations in the 5–50 KHZ and 5–30 KW frequency and power ranges. Ways are disclosed for operating the piezoelectric crystals to steer the hull without need for mechanically moving parts such as flaps or fins.

In practicing the present invention, the boundary layer is fragmented by ultrasonically-induced cavitation. At higher powers and frequencies, the cavitation is capable of virtually eliminating the boundary layer, and forming a so-called cold steam layer, through which frictional resistance to the motion of the torpedo can be substantially reduced.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
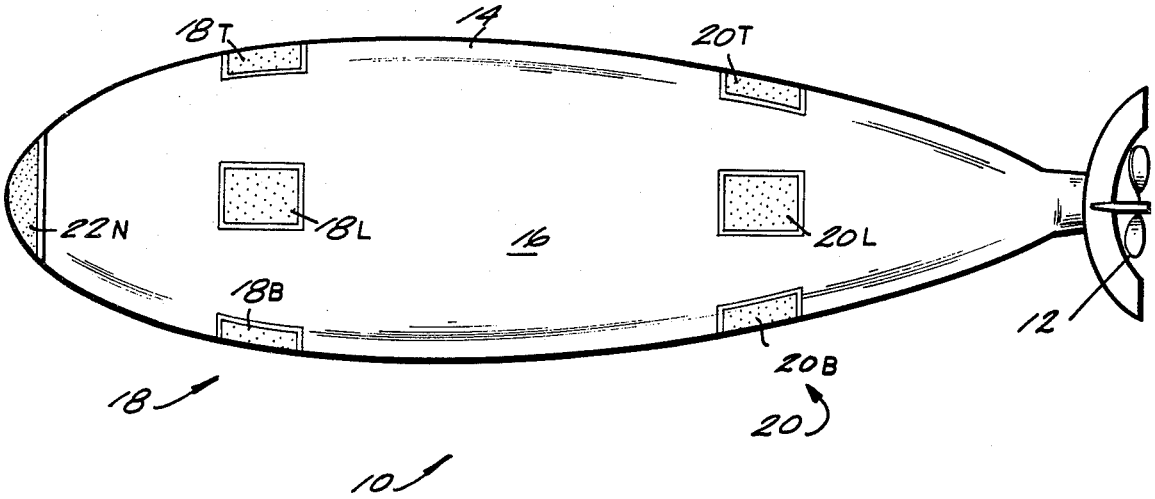
FIG. 1 is a schematic side plan view of a torpedo equipped with ultrasonically vibratable plates for producing controlled cavitation in accordance with the present invention.
Figure 6:
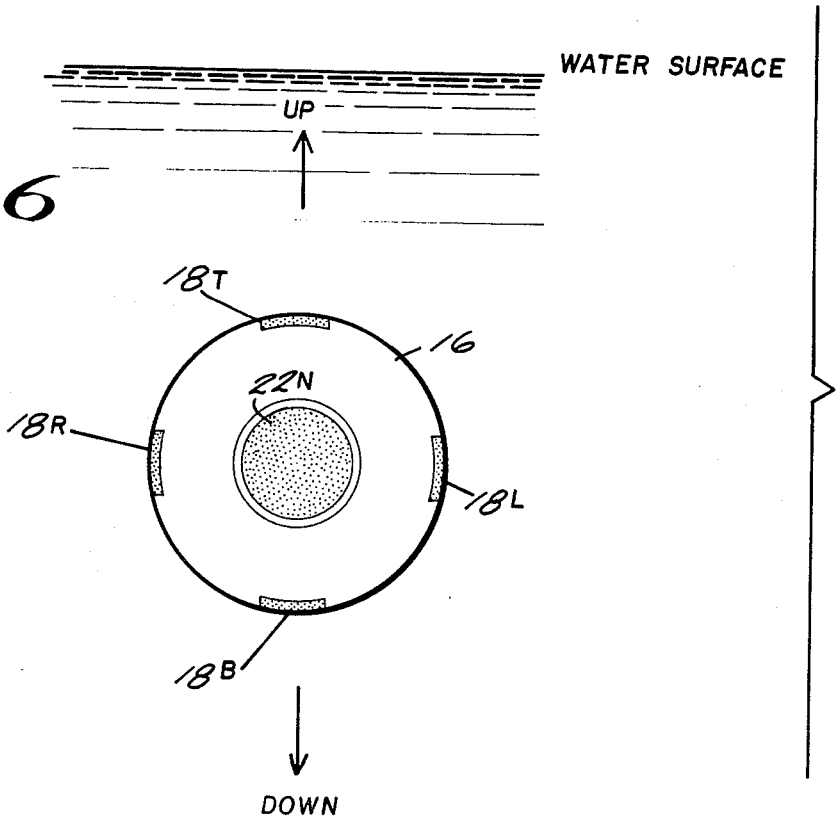
FIG. 6 is a schematic representation of the torpedo in front elevation.

A torpedo is shown at 10 in FIG. 1. It has a conventional motor (not shown) which, when operated, operates a driving means, such as a rotatable propeller 12, to propel the torpedo, underwater, along a generally straightforward path of advance. There is nothing about its internals or externals that is contributed by the present invention with the exception of the apparatus for producing controlled ultrasonic vibrations at the external surface 14 of the hull 16 of the torpedo 10. This apparatus is shown comprising at least one relatively more forward and at least one relatively further aft circumferential ring 18, 20 of flush-mounted individual plates, and a nose plate 22 N. For simplicity in illustration, each ring 18, 20 is shown consisting of four individual plates respectively positioned to face laterally outwards at the top, bottom, left and right of the hull. Accordingly, the numerals designating the respective plates are given the suffixes T (for top), B (for bottom), L (for left), R (for right), and N (for nose).

The external surfaces of the respective plates are preferably shaped to conform with the exterior of the remainder of the torpedo hull so that there is a substantial continuity along and about the exterior of the hull substantially to the extent that such continuity is provided on the exterior of the hull of a conventional torpedo.

Constructionally and operationally, each plate in the ring 18 and each plate in the ring 20 is substantially identical to the others, and the plate 22N in the nose is substantially similar thereto. Accordingly, the plate 18T is illustrated in FIG. 2 as typical of all the lateral plates, and the plate 22N is typically illustrated in FIG. 3.

Figure 2:
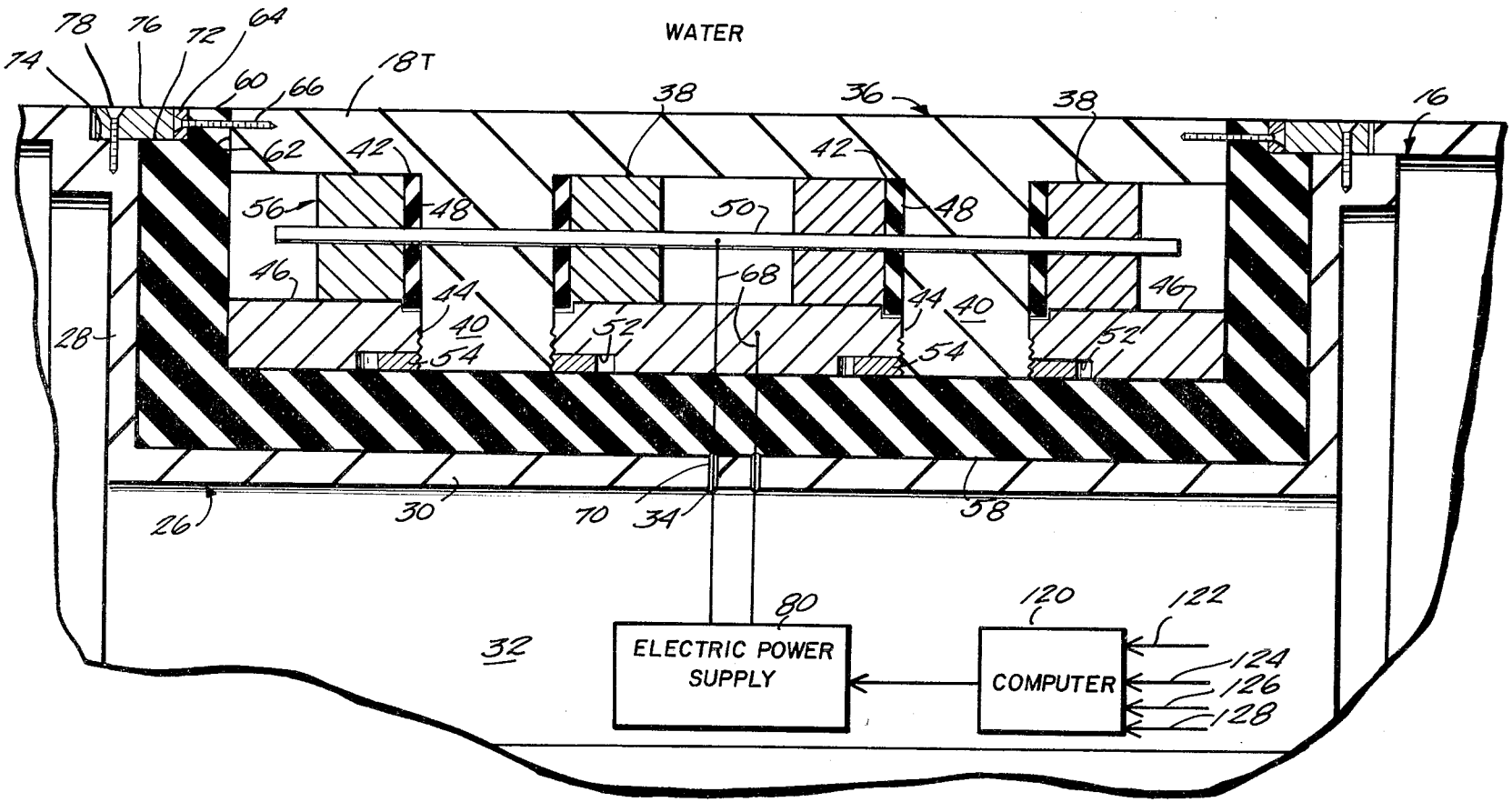
FIG. 2 is a schematic representation of one lateral plate and the control system of the new torpedo.

Referring first to FIG. 2, at each site where a plate in the ring 18 or 20 is to be mounted, the hull 16 is shown formed with a laterally outwardly opening socket or well 26 having a perimetrical sidewall 28 and a radially inner end wall 30 which isolate the respective wells from the internal volume 32 of the torpedo. (Although each lateral plate and each respective well is shown being generally rectangular in plan figure, that need not be the case. They could be circular, oval, ring-shaped, or have any other desired shape.)

The inner end wall of the well 26 is shown provided with a water-tight electrical connector 34 with a suitable plug for plugging-in the respective ultrasonic vibrator assembly 36.

The assembly 36 is shown including one or more piezoelectric crystals 38, the plate 18T which is shown including a pair of medially projecting threaded studs 40 which project through respective openings 42 in the piezoelectric crystal 38, and through respective openings 44 in a back plate 46. Electrical insulator bushings 48 are shown received on the studs 40 40 isolating the common electrode plate 50 of the piezoelectric crystal 38 from the opposite electrode embodied in the back plate 46. Recesses 52 in the inner faces of plate 46 receive the threaded ends of the studs 40 and tightening nuts 54 which are tightened on these studs to hold the resulting sandwich 56 together.

The sandwich 56 is wrapped perimetrically and on its inner end by an integral cup 58 suitably made of conventional rubber gasketing/shock mounting material or the like, and the perimetrical lip 60 at the mouth of the cup is sealingly secured to the perimetrical edge 62 of the plate 18T, by a perimetrically extending batten 64 that is suitably tightened or clamped, e.g. by a series of screws 66.

The electrodes of the piezoelectric crystal sandwich 56 have respective electrical lead wires 68 which pass out through the inner end of the rubber mounting cup 58 in a watertight manner, where they terminate in a suitable electrical plug 70 which is constructed to be plugged into the plug of the electrical connector 34 in a watertight manner.

The outer corner of the rim of the cup 58 and the hull 16 at the mouth of the well 26 are shown provided with complementary perimetrically extending notches 72, 74, which become matched to define a groove 72/74 as the plug 70 is plugged in at 34 and the sandwich 56 is installed in the cup 58. Accordingly, a mounting ring 76 is inserted in the groove 72/74 to fill both of the notches 72 and 74 and is secured in place, e.g. by installing screws 78 through the ring 76 into the hull underlying the notch 74.

Within the volume of the hull, each piezoelectric crystal assembly is provided with an electric power supply 80 suitably electrically connected thereto. Each unit may have a separate power supply, or all may be switchably connected to a common power supply.

Figure 3:
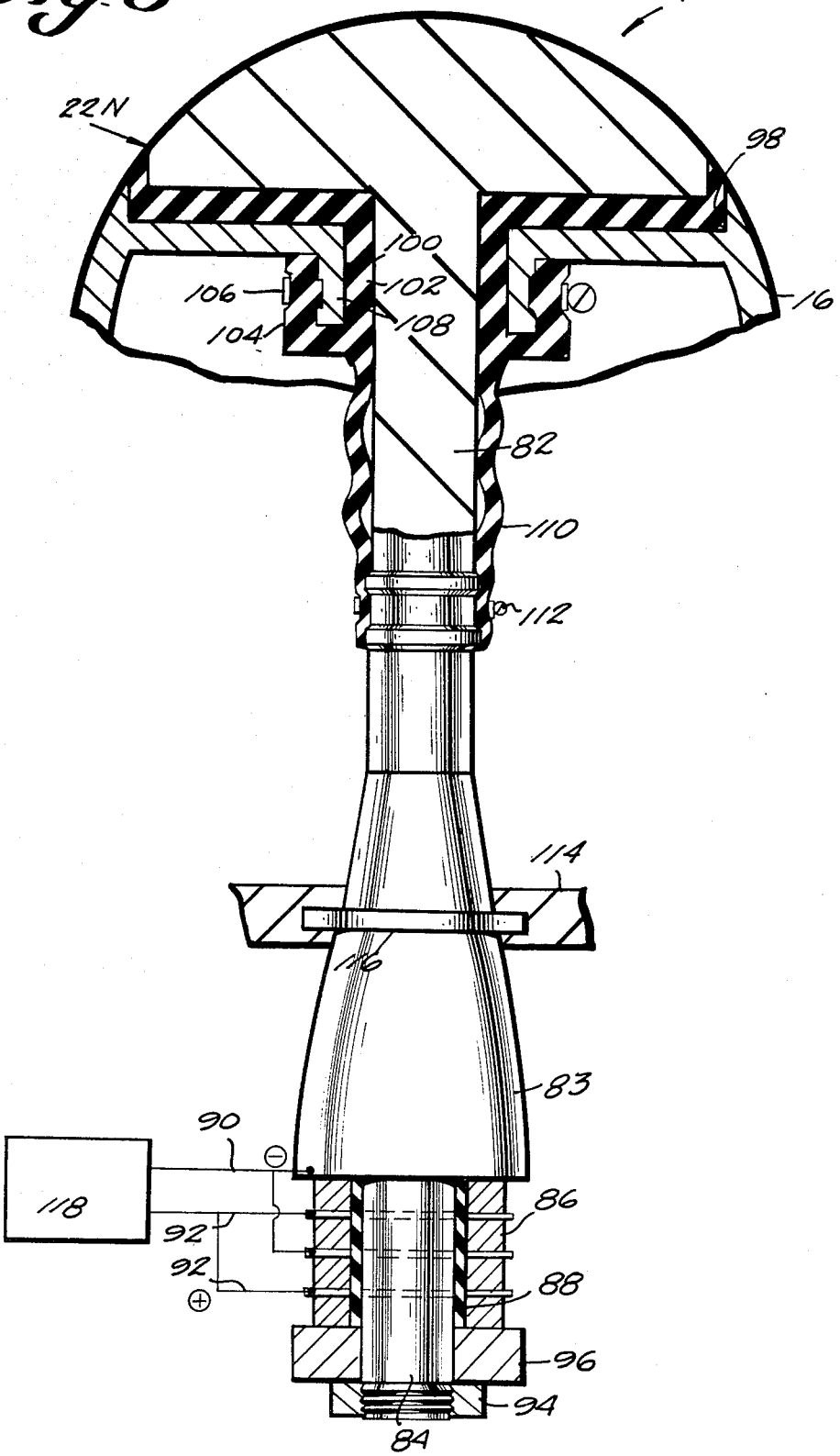
FIG. 3 is a schematic representation of the nose plate of the new torpedo.

Now, with regard to FIG. 3 it can be seen that the nose plate 22N is part of a unit 24 that is, in general, similar to each of the units for the plates in the rings 18, 20. In particular, the nose unit 24 is shown including an externally conforming plate 22N, having a medially projecting rod 82 which merges into an ultrasonic horn 83 about the threaded base-stud 84 of which an annular piezoelectric crystal means 86 is mounted. An electrical insulator sleeve is provided between the stud 84 and the crystal means 86 at 88. Electrical connections are made to the base of the horn and to the common electrode plate at 90, and to the individual crystal electrode plates at 92. The piezoelectric crystals are kept suitably axially compressed by the tightening nut 94 which bears directly on an intervening washer 96. The hull 16 is shown provided with a nose recess 98 having a tubularly-flanged central opening 100 into the internal volume of the torpedo. The unit 24, except for the externally exposed plate 22N is installed through the opening 100, with a rubber gasket/ shock mount 102 interposed therebetween. A collar 104 on the rubber member 102 is circumferentially clamped at 106 to the neck 108, and the tubular neck 110 of the rubber member 102 is circumferentially clamped at 112 to the horn 83, covering the juncture of the rod 82 and horn 83. The horn 83 may be suitably braced to the internal framework 114 of the torpedo intermediate its length, e.g. as illustrated at 116.

The unit 24 is shown provided with a power supply 118 which may be separate from the power supply 80, or in common therewith, but with separate switching.

Referring back to FIG. 2, each power supply 80, 118, etc., is suitably connected to a suitable onboard computer 120, which has conventional inputs 122, 124, 126, etc., from suitable, conventional sensors for depth, orientation, speed and the like, and possibly conventional receiver means 128 for accepting external inputs, e.g. from a submarine, surface ship, or airborne or land-based contol station.

Accordingly, if, as the torpedo 10 is being propelled in a path through the water, below the surface, all of the piezoelectric crystals are operated, such a symmetrical pattern of ultrasonically-induced cavitation will be produced in the water at the interface of the torpedo hull and the water at the nose and sides of the hull, that the torpedo will be able to slip forwards through the water toward the target at a greater rate of speed, for the same propulsive power to the propeller, to provide a greater range for the same total expenditure of energy.

Figure 4:
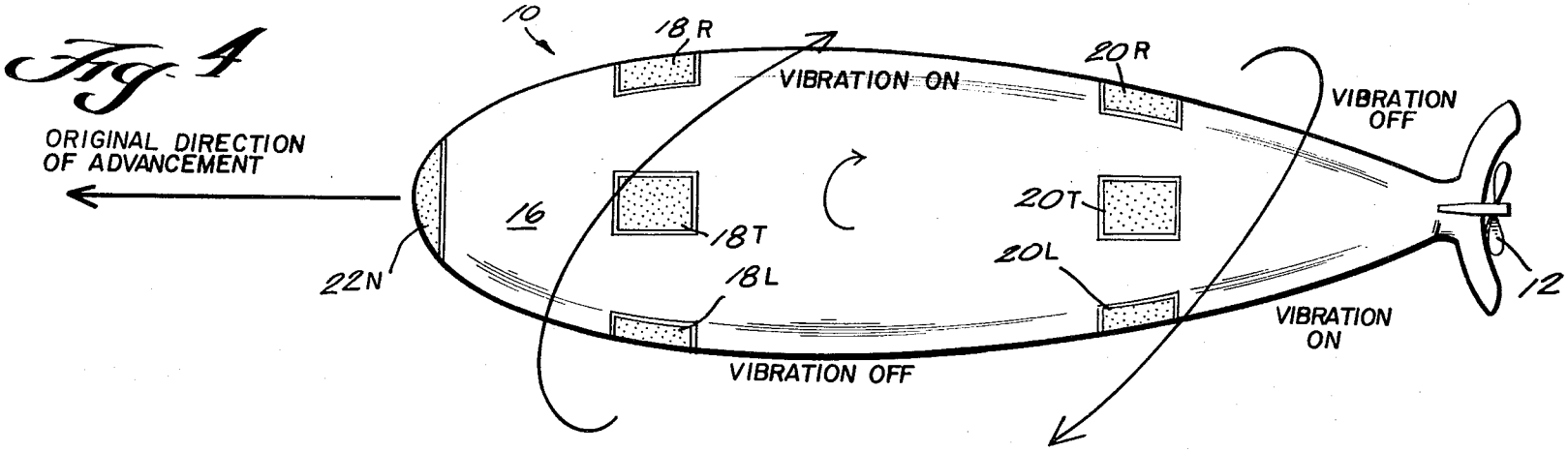
FIG. 4 is a top plan view, showing how the plates are operated to angularly change the course of the new torpedo.
Figure 5:
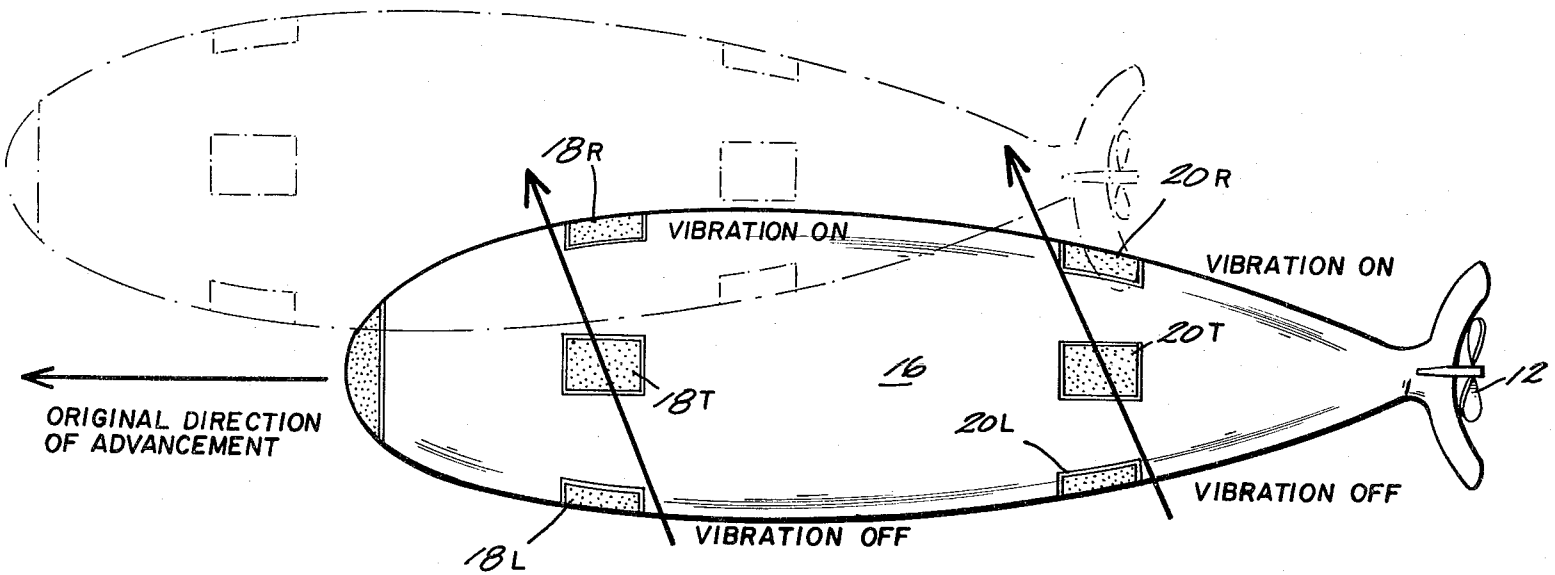
FIG. 5 is a view similar to FIG. 4, showing how the plates are operated to laterally shift the course of the new torpedo.

With reference to FIGS. 4 and 5, two additional desirable features can be easily understood. By using on board sensing or received external commands, the computer can selectively turn off individuals and pairs, etc. of the piezoelectric units, or vary the power to them, to modulate the degrees of symmetry of the pattern of cavitation being produced about the hull in order to change course, i.e. to make mid-course corrections for the path of the torpedo. For instance, as illustrated in FIG. 4, if ultrasonically-vibrating plates 18L and 20R are temporarily turned "off", while all the others remain turned "on", the net effect will be to rotate the torpedo in a right turn maneuver, as suggested by the curved arrows in FIG. 4. However, if, as illustrated in FIG. 5, the ultrasonically vibrating plates 18L and 20L are temporarily turned "off", while all the others remain turned "on", the net effect will be to displace the torpedo obliquely to the right, without changing the azimuth of its heading, as suggested by the oblique arrows in FIG. 5.

(Corresponding turns, flanking maneuvers and the like in all the various directions may be made by selectively turning "off" or turning "up" or "down" the power to the various piezoelectric crystal units).

By preference, the power supplies for the piezoelectric crystal units are capable of vibrating the units in the 5–50 KHZ range, with a power in the 5–30 KW range.

Although the invention is believed to be ideally useful for an underwater hull such as that of a torpedo, because the well-known propensity of intense cavitation to erode metal is of little or no consequence for a hull intended to have such a short operating life, it could be put to use on other short-lived hulls, or where some solution to the erosion problem has been found and put to use.

Accordingly, when the invention is put to use on an underwater hull such as a torpedo hull, range, speed of travel and manueverability may be increased. As a result, survival rate and targeting effectiveness are increased. Because for a given range the expenditure of energy needed to get there is decreased, the on-board power or fuel supply may be decreased, perhaps permitting some increase in payload.

It should now be apparent that the ultrasonic excitation of underwater torpedoes for enhancing their maneuverability, speed and targeting accuracy as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. In an underwater hull such as that of a torpedo, having external wall means defining a longitudinally forwardly-presented nose portion and a laterally-presented portion, where the external wall means has an external surface which is subject to skin friction drag due to the generation and existence on the adjacent to said external surface of a boundary layer of fluid as the hull is advanced through the water, said hull including propulsion means for advancing the hull through the water at such a speed that a substantial portion of such energy as is expended in operating said propulsion means would need to be expended for overcoming said skin friction drag, an improvement for permitting the hull to be advanced through the water by said propulsion means at a substantially reduced expenditure of propulsive energy, due to ultrasonically-induced high-energy continuing fragmentation of the fluid boundary layer adjoining said external surface of said external wall means of said hull, said improvement comprising:

said external wall means at at least one respective site thereof, being provided with an ultrasonically-vibratable plate means having an external face which is generally flush with said external surface of said external wall means of said hull in the surrounding vicinity of said external surface;

each said ultrasonically-vibratable plate means being backed by a respective transducer means, which is mechanically connected therewith for converting energy input having another form, to ultrasonic vibrations which are imparted to the respective said ultrasonically-vibratable plate means; and power supply means contained within said hull and operatively connected with each said transducer means, for ultrasonically vibrating the respective said plate means, said power supply means being constructed and arranged to supply sufficient power to each said transducer means as to cause the respective said plate means to ultrasonically vibrate with such power, when operating, that ultrasonically-induced fragmentation of said fluid boundary layer adjoining said external surface of said external wall means of said hull is caused to occur in the vicinity of the respective said plate means, whereby said hull may be more easily advanced through the water in a direction toward where said fluid boundary layer is being fragmented to a greater extent.

2. The underwater hull of claim 1, wherein:

said plate means of at least one said transducer means is axially centrally located in said nose portion.

3. The underwater hull of claim 1, wherein:

said plate means of at least one said transducer means is laterally presented in said laterally-presented portion.

4. The underwater hull of claim 1, including:

at least two said transducer means, including one having said plate means thereof axially centrally located in said nose portion and another having said plate means thereof laterally presented in said laterally-presented portion.

5. The underwater hull of claim 1, wherein:

said power supply means for each said transducer means is provided with a capacity to vibrate the respective said plate means in the 5–50 KHZ range with a power in the 5–30 KW range.

6. The underwater hull of claim 1, wherein:

each transducer means comprises a respective piezoelectric crystal.

7. The underwater hull of claim 1, including:

at least said transducer means, including one having said plate means thereof laterally presented in said laterally-presented portion at a first respective site and another having said plate thereof laterally contrastingly presented in said laterally-presented portion at a second respective site which is angularly spaced part-way around said hull from said first respective site.

8. The underwater hull of claim 7, further including:

at least a third said transducer means, said third transducer means having said plate means thereof axially centrally located in said nose portion.

9. The underwater hull of claim 1, including:

at least two axially spaced circumferential rings each made up of a plurality of angularly spaced ones of said plate means, each such plate means being laterally presented in said laterally-presented portion.

10. The underwater hull of claim 9, wherein:

one of said plate means is axially centrally located in said nose portion.

11. The underwater hull of claim 9, wherein:

in each said ring there are at least four such plate means, including a first presented laterally upwards, a second presented laterally downwards, a third presented laterally leftwards, and a fourth presented laterally rightwards.

12. The underwater hull of claim 7, claim 9 or claim 11, further including:

on-board control means for said power supply means for altering the path of movement of said hull, mid-course, by at least temporarily providing less power to at least one said plate means than to at least another said plate means via the respective transducer means.

13. A method for steering an underwater hull such as that of a torpedo having an external wall defining a longitudinally forward-presented nose portion and a laterally-presented portion, where the external wall has an external surface which is subject to skin friction drag due to the generation and existence on and adjacent to said external surface of a boundary layer of fluid as the hull is advanced through the water, said hull including a propulsion device for advancing the hull through the water at such a speed that a substantial-portion of such energy as is expended in operating said propulsion device would need to be expended for overcoming said skin friction drag, and for permitting the hull to be advanced through the water by said propulsion device at a substantially reduced expenditure of propulsive energy, due to ultrasonically-induced high-energy continuing fragmentation of the fluid boundary layer adjoining said external surface of said external wall of said hull, said method comprising:

(a) providing said external wall at at least three respective sites thereof with respective ultrasonically-vibratable plates each having an external face which is generally flush with said external surface of said external wall of said hull, at least one of these plates being directed substantially axially forwardly from said nose portion and at least two others of these plates being directed laterally outwards from said laterally-presented portion, said sites of these two plates being angularly spaced part-way around said hull from one another; and (b) controllingly supplying ultrasonic vibrational power to each of said plates from within said hull for at least sometime vibrating ones of the respective plates sufficiently to produce ultrasonically-induced fragmentation of said fluid boundary layer adjoining said external surface of said external wall of said hull in the vicinity of the respective said plates, whereby said hull may be more easily advanced through the water in a direction toward where said fluid boundary layer is being fragmented, including (c) while propelling said hull through the water along a path of movement underwater using said propulsion device, altering said path of movement, mid-course, by at least temporarily providing less power to at least one of said laterally outwardly directed plates than to at least another of said laterally outwardly directed plates.

* * * * *